United States Patent [19]

Galiasso Tailleur et al.

[11] Patent Number: 4,469,587

[45] Date of Patent: Sep. 4, 1984

[54] PROCESS FOR THE CONVERSION OF ASPHALTENES AND RESINS IN THE PRESENCE OF STEAM, AMMONIA AND HYDROGEN

[75] Inventors: Roberto E. Galiasso Tailleur; Jose A. Salazar Guillen, both of Los Teques; Donald Huskey, Caracas; Alfredo L. Morales; Luig G. Aquino, both of Los Teques, all of Venezuela

[73] Assignee: Intevep, S.A., Caracas, Venezuela

[21] Appl. No.: 528,808

[22] Filed: Sep. 2, 1983

[51] Int. Cl.[3] ..... C10G 67/04; C10G 69/06

[52] U.S. Cl. ..... 208/61; 208/96; 208/97; 208/107; 208/130

[58] Field of Search ..... 208/61, 72, 75, 96, 208/97, 102, 107, 108, 128, 130

[56] References Cited

U.S. PATENT DOCUMENTS

| | | | |
|---|---|---|---|
| 2,001,444 | 5/1935 | Zotos | 208/130 |
| 2,413,407 | 12/1946 | Dreyfus | 208/130 |
| 2,704,738 | 3/1955 | Simpson | 208/309 |
| 2,847,353 | 8/1958 | Beavon | 208/309 |
| 3,136,712 | 6/1964 | Van Driesen | 208/58 |
| 3,321,394 | 5/1967 | Mills | 208/45 |
| 3,353,920 | 11/1967 | Kitzen | 208/130 |
| 3,557,241 | 1/1971 | Kivlen et al. | 208/130 |
| 3,562,146 | 2/1971 | Deanesly | 208/130 |
| 3,622,499 | 11/1971 | Stine et al. | 208/108 |
| 3,666,658 | 5/1972 | Hallman | 208/103 |
| 3,761,538 | 9/1973 | Espino et al. | 208/130 |
| 3,794,580 | 2/1974 | Ladeur | 208/110 |
| 3,848,017 | 11/1974 | Shalit | 208/130 |
| 4,159,937 | 7/1979 | Scott | 208/104 |
| 4,191,636 | 3/1980 | Fukui et al. | 208/110 |
| 4,214,979 | 7/1980 | Nakanishi et al. | 208/128 |
| 4,400,264 | 8/1983 | Kwant et al. | 208/64 |

*Primary Examiner*—Delbert E. Gantz
*Assistant Examiner*—O. Chaudhuri
*Attorney, Agent, or Firm*—Bachman and LaPointe

[57] ABSTRACT

A process for upgrading heavy crude comprises the hydroconversion of asphaltenes and resins in the presence of steam and ammonia at high temperatures, followed by deasphalting to eliminate metals and remaining asphaltenes. By way of the process of the present invention, conversion of asphaltenes and resins is accomplished while at the same time insuring a low formation of gases and coke so as to obtain an end product with a high yield of distillates and low metal content. The process is particularly suitable for any type of heavy crude, for example those of the Orinoco zone, which possess a high content of asphaltenes and metals.

26 Claims, 3 Drawing Figures

REACTOR SOAKER 430°C, 127 ATM, 1.55h
EFFECT OF ADDITIVES IN VARIATIONS OF PROPERTIES.

REACTOR SOAKER 430°C, 127 ATM, 1.55 h
EFFECT OF THE ADDITIVES IN THE VARIATION OF PROPERTIES.

PROCESS FOR THE CONVERSION OF ASPHALTENES AND RESINS IN THE PRESENCE OF STEAM, AMMONIA AND HYDROGEN

BACKGROUND OF THE INVENTION

The present invention relates to a process for upgrading heavy crude and, more particularly, for upgrading heavy crude having high contents of asphaltenes and metals so as to increase the yield of distillates.

Ever increasing energy demands in combination with decreasing reserves of light crudes and the existence of large deposits of heavy crudes have made it highly desirable to develop new processes for upgrading heavy crudes into more valuable hydrocarbon products. While various prior art processes claim to effectively convert heavy crudes to lighter crudes, none have proved to be commercially viable for various reasons. For example, visbreaking has been found to be an effective method for increasing the yield of gasoline at the expense of the residual fractions, but visbreaking by itself is not sufficient for obtaining high yields of distillable products, and moreover there is the serious disadvantage that increasing severity to reach greater yields results in more unstable products and increased production of coke.

U.S. Pat. Nos. 4,179,355, 2,717,285, 3,132,088, and 3,148,135 disclose combinations of processes such as visbreaking, deasphalting and hydrogenation, which also does not guarantee economically obtaining high yields of liquids at the expense of the asphaltenes and resins.

The process described in European Pat. No. 0048098 A2 consists of a less severe visbreaking in the presence of fine particulate solids of coal, which permits reaching greater yields of distilled products, but at the expense of a segregation and deposition of coke on the solid particles; the visbreaking effluents then pass to a deasphalting unit to separate the asphalt solids, with later separation in aqueous medium of the solid organic phase (in suspension) of the inorganic ash, which stay sedimented.

British Pat. No. 2,074,186 A consists of a deasphalting of the charge, followed by a hydrovisbreaking of the deasphalted oil (DAO), and finally a stage of conversion in the presence of a catalyst.

Other patents, such as U.S. Pat. Nos. 3,280,073 and 3,293,169 also claim a thermal process followed by a catalytic hydrocracking including a previous deasphalting.

As can be seen, none of the processes mentioned obtain a greater yield of liquids by means of a controlled conversion of asphaltenes.

There exist in the prior art, processes which utilize a hydrogen donor in the hydroconversion stage, as disclosed in U.S. Pat. No. 3,338,818. This permits a greater severity to be reached in the hydroconversion stage without greater formation of coke, with an appreciable conversion of asphaltenes and a conversion of the 950° F. fraction amounting to 50 vol. %. However, the use of a hydrogen donor requires the introduction into the overall scheme of the process an additional hydrogenation stage, which has the result of a different product distribution from that obtained by means of the present invention, at a high cost.

Accordingly, it is the principal object of the present invention to provide a process for the controlled conversion of asphaltenes and resins and a high conversion of the residual fraction.

It is a particular object of the present invention to provide a process for the controlled conversion of asphaltene resins which is relatively inexpensive to practice.

Further objects and advantages will appear hereinbelow.

SUMMARY OF THE INVENTION

In accordance with the present invention the foregoing objects and advantages are readily obtained.

The present invention comprises a particular combination of processes for the controlled conversion of asphaltenes, resins and 950° F.+ residuum, not known in the prior art, and consists of the treatment of the crude and/or its atmospheric residue and/or vacuum residue containing more than 5% of asphaltenes in a first thermal hydroconversion stage in the presence of steam and ammonia to diminish the content of asphaltenes, the formation of coke and the consumption of hydrogen, and, at the same time, increase the liquid yield. In the first stage, the original material and part of the unconverted recycled material are treated in high severity conditions, to reach conversions of 30–70% of asphaltenes and up to 70–90% of the 950° F.+ fraction. The different fractions are later separated by distillation, and the light fractions pass to a hydrofinisher or to the synthetic crude. The residue, is in turn, is passed to deasphalting in the presence of water and heavy solvent. The water permits a substantial reduction in the quantity of solvent and avoids the entrainment of solvent with the asphaltenes.

The deasphalted product (DAO) is hydrotreated for elimination of sulfur and vanadium, in the presence of one or more catalyst beds with different pore and particle sizes, in an arrangement permitting a maximum capture of metals and cycle duration without operating problems. The catalysts employed contain metals of Groups VIB and VIII of the Periodic Table, supported on a refractory material of the type of silica, alumina, titanium, or combinations of these.

Other alternatives consist of sending the DAO as part of the fuel oil for use in the production field, or recirculating it to extinction of the 950° F.+ fraction in the hydroconversion stage.

DETAILED DESCRIPTION

Figure 1:
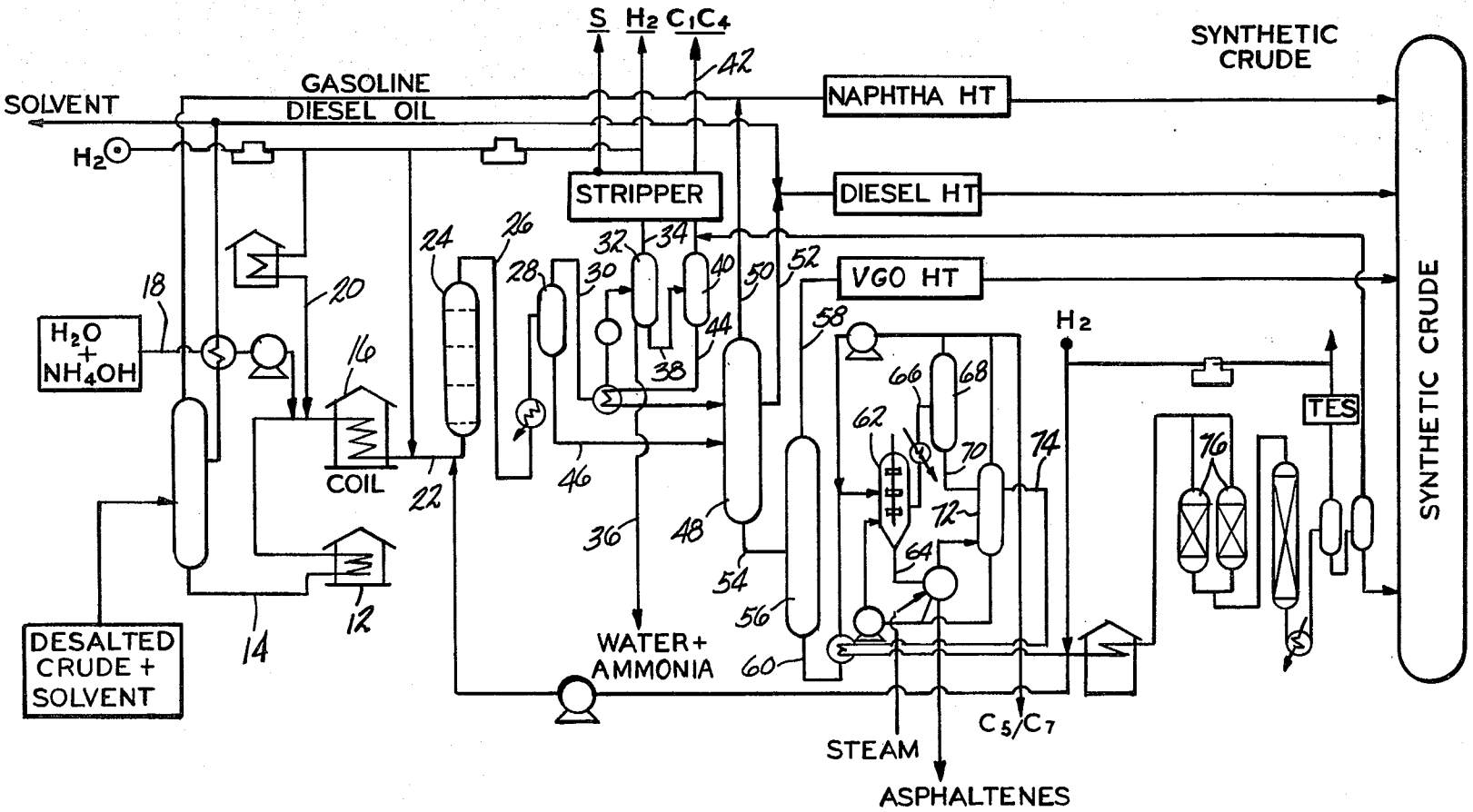
FIG. 1 is a schematic flow diagram illustrating the process of the present invention.

In accordance with the process of the present invention, the hydrocarbon feed, which may be in the form of a heavy crude and/or its atmospheric residue or vacuum residue (previously desalted), is pumped to a preheating zone 12 via line 14 and then to a helicoidal reactor reaction zone 16. A mixture of steam and the ammonia joins this stream via line 18 (or in localized injections along the reactor), and the mixture is fed to the reaction zone 16, together with preheated hydrogen delivered via line 20, through the top or through the bottom of the helicoidal reactor (preferably through the top). The concentration of ammonia utilized is comprised between 0.1 and 10% by volume, preferably between 0.3 and 8%. This solution is then used in a ratio of between 0.1 and 30% by volume with respect to the crude and/or vacuum or atmospheric residue, preferably between 5 and 10% by volume. The hydrogen/charge ratio is variable between 300 and 4,500 $Nm^3/m^3$; the hydrogen which leaves the hydrotreatment stage can be used if it is previously purified, along with an addition of the required quantity of fresh hydrogen to maintain the hydrogen/charge ratio and the partial pressure of hydrogen at the input to the helicoidal reactor.

The residence time of the liquid and gas in this first hydroconversion stage in the helicoidal reactor 16 can vary between 0.32 and 64.3 min, with a linear velocity comprised between 0.1 and 20 cm/sec, and are heated such that starting from 230° C. a Log$\Delta$t average of 30°/150° C. between the bulk of the liquid and the reactor wall is obtained, with a heat transfer velocity variable between 5,000 and 10,000 $kcal/hm^2$. In this way the temperature of the liquid in the first thermal stage progressively increases up to a maximum comprised between 420° and 540° C. the preferred value being between 440° and 500° C., the operating conditions being such that the conversion in the coil reactor 16 produces an approximately zero heat of reaction and the consumption of hydrogen is less than 150 $ft^3/bbl$. The operating pressure used can be varied between 20 and 200 atmospheres, the preferred value being 50 to 150 atmospheres.

The effluent from the first thermal stage passes via line 22 to a second thermal hydroconversion stage 24 in which the effective linear velocity of the liquid and gas in upward flow in the reactor (soaker) can be varied between 0.03 and 0.3 cm/sec, and a residence time variable between 10 and 90 minutes, preferably between 20 and 70 minutes. The working temperature is variable between 420° and 480° C., preferably between 430° and 460° C., which is less than in the helicoidal reactor and is achieved without external heat supply. The pressure is substantially the same as in the helicoidal reactor (20 to 200 atmospheres), preferably from 50 to 150 atmospheres. This second stage is likewise carried out in the presence of steam and ammonia in a ratio comprised between 0 and 30% by volume with respect to the hydrocarbon and a hydrogen/hydrocarbon ratio comprised between 300 and 4,500 $Nm^3/m^3$. This second reactor 24 is of the bubble column type using as internals various distributors of the bubble plate type or perforated baffle type in order that the bubble is not greater than 10 cm in diameter and the coefficient of axial dispersion is comprised between 40 and 200 $cm^2/sec$, to ensure an appropriate $H_2$/hydrocarbon mixture and to diminish coke formation.

The effluents of this second thermal hydroconversion stage pass via line 26 to a high pressure-high temperature separator 28 at a temperature of between 350°–400° C., and at the same pressure as the previous reactor 24, to separate as heads via line 30 the hydrogen, the $H_2O$, and the light hydrocarbons. This head stream then passes to a low temperature, high pressure separator 32 for the recovery of hydrogen, $H_2S$ and $NH_3$ as heads via line 34; the water and ammonia are eliminated at the bottom via line 36 and the light hydrocarbons pass via line 38 to a third, low temperature and low pressure, separator 40 for recovery of the $C_1$–$C_4$ as heads via line 42 and the condensed hydrocarbons leave by the bottom via line 44. The $H_2S$ and $NH_3$ are eliminated from the hydrogen-rich stream by means of a conventional process which forms no part of the present invention and the hydrogen is recirculated to the hydroconversion stage.

The bottoms liquid from the high temperature, high pressure separator 28 is passed via line 46 to an atmospheric pressure distillation column 48 wherein the atmospheric pressure distillates are sent to hydrofinishing for adjusting the synthetic crude via lines 50 and 52. The atmospheric pressure residue is sent via line 54 to vacuum distillation column 56 from which the vacuum gasoil is sent to hydrotreatment via line 58 and the vacuum residue is sent via line 60 to be deasphalted in the presence of water in a decanter 62. The deasphalting step takes place in the presence of water, with percentages of water being in the range comprised between 5 and 20% by volume with respect to the solvent, and the solvent used is a hydrocarbon comprising $C_5$ to $C_7$ or mixture of these, where 95% of water is recovered in the asphaltenes. The deasphalting is affected in a decanter 62 at a temperature comprised between 180° and 230° C. and pressures comprised between 15 and 50 atmospheres. The solvent/hydrocarbon ratio is comprised between 2:1 and 10:1 by volume, preferably between 4:1 and 9:1. The solvent/asphalt ratio for the decanter bottoms is less than 5% and the DAO/Asphaltenes ratio is less than 10%. The solid asphaltenes are then recovered via line 64, milled, and sent for combustion, this stream being in all cases less 70% by weight of the asphaltenes fed in via line 14. Alternatively, then can be recovered in an aqueous suspension from the bottom of the decanter 62 and sent to combustion after recovery of the solvent. The deasphalted stream (DAO) is delivered via line 66 to 68 and, after evaporation of the solvent in 68, is passed via line 70 to water recovery unit 72, and thereafter to hydrotreatment unit 76 via line 74 to eliminate sulfur and the vanadium. This hydrotreatment is carried out in a fixed bed reactor 76, using one or more beds of catalysts of different mean pore diameters and different particle sizes in an arrangement which permits the maximum capture of metals and duration of the cycle without operating problems. These catalysts have the characteristics set forth in Table I below.

TABLE I

CATALYST FOR HDM AND HYDROFINISHING

| PROPERTIES | BROAD | PREFERRED |
|---|---|---|
| $MoO_3$ (wt. %) | 0–20 | 8–15 |
| $WoO_3$ (wt. %) | 0–20 | 5–10 |
| NiO (wt. %) | 0–8 | 2–6 |
| CoO (wt. %) | 0–8 | 2–6 |
| $SiO_2$ (wt. %) | complement | complement |
| $Al_2O_3$ (wt. %) | complement | complement |
| Particle size (inch) | 1/32–¼ | 1/16–1/6 |
| B.E.T. Area ($m^2/g$) | 50–300 | 150–300 |
| Pore volume (cc) | 0.6–1.4 | 0.8–1.2 |
| Pore diameter (Å) | 80–400 | 110–200 |
| Apparent density (g/cc) | 0.6–1.5 | 0.8–1.4 |
| Real density (g/cc) | 2–7 | 4–6.2 |
| Bed strength ($kg/m^2$) | 0.4–0.9 | 0.54–0.8 |
| Pellet strength (Kg/pellet) | 2–6 | 2.4–5 |
| Pore distribution (% Vp) | | |
| 20–30 | 0–40 | 0–20 |
| 30–60 | 0–40 | 0–20 |
| 60–90 | 0–50 | 20–40 |
| 90–150 | 0–50 | 10–40 |

TABLE I-continued

| CATALYST FOR HDM AND HYDROFINISHING | | |
|---|---|---|
| PROPERTIES | BROAD | PREFERRED |
| 150-300 | 0-40 | 0-20 |
| 300-10 | 0-40 | 0-20 |
| 10 | 0-40 | 15-35 |

The catalyst used for the hydrotreatment contains at least one compound (preferably Mo or W) selected from the elements of Group VIB of the Periodic Table, in an amount of about 5 to 15% by weight (as oxide); at least one metallic compound selected from the metals of Group VIII of the Periodic Table (preferably Co or Ni), in an amount of about 2 to 6% by weight (as oxide), supported on refractory materials of the type of $SiO_2$ or $Al_2O_3$ or a combination of these, wherein the pore distribution is such that it contains 40% of pores larger than 100 Å, that it has a surface area comprised between 150 and 300 $m^2/g$, and a pore volume comprised between 0.8 and 1.2 $cm^3/g$. The catalysts are prepared by successive impregnations of metals of Groups VIB and VIII on the macroporous supports, which contain more than 40% of pores of radius greater than 100 Å. The soluble salt of the Group VIB metal is placed in contact with the support for a time which can be varied between 0 and 24 hours, preferably from 1 to 5 hours. The impregnated material is dried at a temperature of 80°-120° C. and calcined at 400°-600° C. (preferably 450°-550° C.). This calcined catalyst is then placed in contact with a solution of one or more metals of Group VIII for a time between 0.2 and 5 hours, preferably between 0.5 and 3 hours, again dried at 80°-120° C., activated at a temperature of 400°-600° C. (preferably 450°-550° C.), then treated with steam at 600° C. and finally presulfurized in the presence of carbon disulfide and hydrogen at a temperature of 230°-350° C. In the case of the utilization of two or more catalytic beds, these can be disposed in the same reactor or in separate reactors in series and of such form that a homogeneous distribution of metal deposition is obtained along the catalyst bed.

The hydrotreatment takes place under the following operating conditions: the working pressure varies between 20 and 200 atmospheres, preferably 50-150 atmospheres, the temperature between 350° and 440° C., preferably 370°-430° C. The hydrogen/hydrocarbon ratio varies between 100 and 2,000 $Nm^3/m^3$, preferably between 300 and 1,500 $Nm^3/m^3$. In both the first and the second catalyst bed, the hydrocarbon and the hydrogen react such that the ratio of final temperature to initial temperature in ° C. is less than 1.2. The linear velocity of the liquid in the reactor is variable between 0.4-30 m/h, preferably between 0.5-20 m/h. The reaction is carried out there such that the ratio of input temperature to exit temperature and the linear velocity of the liquid in the reactor are essentially the same as those specified for the first bed. The present invention is not limited to the use of one or two reactors, one or two catalysts, but a chemical reaction arrangement composed of one or more catalysts and one or more reactors in accordance with the final specifications of the products and the required operating time. The DAO obtained in the deasphalting stage may be recycled to the second thermal stage for its conversion to distillable products.

As demonstrated in the examples described below, it has been found that under these particular conditions, and only under these conditions, there is obtained an adequate conversion of asphaltenes (30-70%) and of the residual fraction 510° C.+ (70-90%) with a high yield of liquids and low formation of gases and coke, with good operability and minimum energy consumption.

EXAMPLE I

This example represents the type of trials which show the suppressive effect of water on coke formation.

A complete Morichal crude having the characteristics set forth in Table II was treated in an autoclave of 2.5 liters capacity, with and without the presence of steam and hydrogen.

TABLE II

| CHARACTERISTICS OF MORICHAL CRUDE | |
|---|---|
| API Gravity | 11.8 |
| Sulfur (% by weight) | 2.85 |
| Vanadium (ppm) | 331 |
| Nickel (ppm) | 89.1 |
| Conradson carbon (wt. %) | 12.0 |
| Asphaltenes (wt. %) | 9.0 |
| Viscosity (Cst) | |
| 140° F. | 600 |
| 110° F. | 3,533 |
| Water (wt. %) | 0.1 |
| Bromine number | 12 |
| Carbon (wt. %) | 84.3 |
| Hydrogen (wt. %) | 10.5 |
| Distillation (TBP) | |
| ASTM-D2892 by wt. % | |
| 375° F. | — |
| 375-650° F. | 10.8 |
| 650-950° F. | 30.7 |
| 950° F. | 58.5 |

The reaction conditions are set forth in Table III below.

TABLE III

| EFFECT OF WATER ON FORMATION OF CARBON | | | | | | |
|---|---|---|---|---|---|---|
| Temperature (°C.) | $FH_2$ (liters/min) | Pressure (psig) | $T_r$ (min) | Water/Feedstock (vol. %) | Coke (wt. %) | Yield (wt. %) |
| 420 | 4.0 | 1,500 | 60 | | 11 | 96.6 |
| 420 | 4.0 | 1,500 | 60 | 10 | 4.18 | 94.3 |

As can be seen from Table III, the coke formed when water is present is less than 62% with respect to the formation without water.

EXAMPLE II

This example represents the type of trials which demonstrate the effect of water and ammoniacal water on the conversion of asphaltenes and carbon.

This trial was accomplished with a model charge containing 8.26% of asphaltenes, likewise in a 2.5 liter autoclave, in the presence of hydrogen, steam, and ammonia. The results and conditions of operation are set forth in Table IV, below.

TABLE IV

| CONVERSION OF ASPHALTENES IN PRESENCE OF STEAM AND AMMONIACAL WATER | | | | |
|---|---|---|---|---|
| Charge | *$\Delta sf_i$ (g) | **$\Delta sf_f$ (g) | % coke | % asphaltenes converted |
| HVGO + asphalt | 117 | 86.41 | 1.49 | 26.16 |
| HVGO + asphalt + $H_2O$ | 117 | 72.40 | 0.80 | 38.12 |
| HVGO + asphalt + | 117 | 38.65 | 0.62 | 66.97 |

TABLE IV-continued

CONVERSION OF ASPHALTENES IN PRESENCE OF STEAM AND AMMONIACAL WATER

| Charge | *$\Delta sf_i$ (g) | **$\Delta sf_f$ (g) | % coke | % asphaltenes converted |
|---|---|---|---|---|
| $H_2O + NH_3$ | | | | |

Conditions:
Temperature: 430° C.
Reaction time: 60 min
Hydrogen flow: 4.65 liters/min
Pressure: 1,800 psig
*$\Delta sf_i$ = initial, grams of asphaltenes
**$\Delta sf_f$ = final, grams of asphaltenes As can be seen, the conversion of asphaltenes is found to be of the order of 66.97% for water plus ammonia and 38.12 for water alone.

EXAMPLE III

This example constitutes the trial carried out with a Cerro Negro crude of 5.3° API in the presence of water, utilizing a thermal stage of medium severity (reactor coil) in down flow, followed by a second thermal stage of greater severity (reactor soaker) in up flow of $H_2$ and charge; then a distillation stage followed by a stage of deasphalting with hexane of the residue, also in the presence of water, and of a hydrotreatment of the various fractions obtained. The operating conditions are shown in Table V.

TABLE V

CONDITIONS OF OPERATION OF THE DIFFERENT STAGES OF THE PROCESS

| | HYDROCONVERSION STAGE | | | |
|---|---|---|---|---|
| | 1st THERMAL STAGE | 2nd THERMAL STAGE | DEASPHALTING STAGE | STAGE OF HDT OF DAO |
| Pressure | 1,800 | 1,800 | 400 | 1,500 |
| Reaction temp. (°C.) | 480 | 440 | 150 | 390 |
| Water (vol. %) | 10 | 10 | 10 | — |
| Hydrogen/charge ratio | 1,408 | 1,408 | — | 1,000 |
| Residence time (min.) | 26 | 70.8 | — | 200 |
| Hexane/charge ratio (v/v) | — | — | 9 | — |
| Catalyst | — | — | — | 80% AMN-5.11<br>20% AMN-5.09 |

STAGE OF HYDROTREATMENT OF THE DISTILLATE CUTS

Pressure (psig) = 700
Bed temperature (°C.) 350 (cut 375° F. - ), 380 (cut 375–650° F.), 390 (cut 650–950° F.)
Space velocity ($h^{-1}$) = 1
Hydrogen/charge ratio (liter/liter) = 600
Catalyst = Shell 324

The results obtained after the stage of hydrovisbreaking and then of hydrotreatment of the DAO of the 950° F.+ residue can be seen in Table VI.

TABLE VI

QUALITY OF PRODUCTS OBTAINED BY COMBINATION OF (1) THERMAL HYDROCONVERSION, (2) DEASPHALTING, AND (3) HYDROTREATMENT STAGES

| | Residuum (350° C. +) of Cerro Negro | Stage (1) Product | Stages (1) + (2) + (3) Final Product |
|---|---|---|---|
| API Gravity | 5.3 | 21.2 | 29.5 |
| Sulfur (wt. %) | 4.32 | 3.31 | 0.4 |
| Vanadium (ppm) | 550.39 | 407 | 17.97 |
| Conradson Carbon (wt. %) | 17.05 | 8.9 | 1.28 |
| Asphaltenes ($C_6$) | 16.67 | 8.72 | 0.23 |
| Nitrogen (ppm) | 8.268 | 2.998 | 1.383 |
| Kim Viscosity | | | |
| (Cst) 140° F. | | | — |
| 110° F. | Not | 22.25 | — |
| 210° F. | Fluid | 3.76 | — |
| Water (vol. %) | 10 | | |
| $H_2$ consumption ($Nm^3$/metric ton) (?) | — | 149.95 | 238 |
| Distillation (TBP) ASTM-D2892 | | | |
| 375° F. | — | 1.38 | 15.34 |
| 375–650° F. | 1.28 | 30.31 | 35.93 |
| 650–950° F. | 20.05 | 38.80 | 42.56 |
| 950° F. | 78.67 | 17.09 | 6.17 |

In Table VII below we have the characterization of the various fractions before and after hydrofinishing.

TABLE VII

HYDROTREATMENT OF THE DISTILLED FRACTIONS

| CUTS | 375° F.(−) (no HT) | 375° F.(−) (HT) | 375–650° F. (no HT) | 375–650° F. (HT) | 650–950° F. (no HT) | 650–950° F. (HT) | DAO 950° F. (no HT) | DAO 950° F. (Ht) |
|---|---|---|---|---|---|---|---|---|
| API gravity | 40.8 | 44.7 | 26.6 | 33.9 | 16.9 | 23.9 | 10.9 | 13.7 |
| Sulfur (wt. %) | 0.77 | 0.08 | 1.91 | 0.07 | 2.99 | 0.33 | 6.53 | 1.86 |
| Vanadium (ppm) | 1 | 1 | 1 | 1 | 2 | 2 | 709.6 | 212.9 |
| Nickel (ppm) | 2 | 2 | 2 | 2 | 2 | 2 | — | — |

TABLE VII-continued

| HYDROTREATMENT OF THE DISTILLED FRACTIONS | | | | | | | | |
|---|---|---|---|---|---|---|---|---|
| | | | | | | | DAO | |
| CUTS | 375° F.(−) (no HT) | 375° F.(−) (HT) | 375–650° F. (no HT) | 375–650° F. (HT) | 650–950° F. (no HT) | 650–950° F. (HT) | 950° F. (no HT) | 950° F. (Ht) |
| Conradson Carbon (wt. %) | — | — | 0.27 | 0.02 | | 0.21 | 7.4 | 2.79 |
| Nitrogen (ppm) | 94 | NIL | 481 | NIL | 2595 | 489 | 13732 | 12429.4 |
| Viscosity | | | | | | | | |
| (Cst) 140° F. | — | — | 3.39 | 2.23 | 18.62 | 7.99 | — | — |
| 100° F. | — | — | 5.77 | 3.56 | 58.88 | 20.06 | — | — |
| Bromine no. | 14 | 0 | 9 | 1 | 10 | 7 | — | — |
| Paraffins (wt. %) | 31.07 | 38.70 | — | — | — | — | — | — |
| Naphthenics (wt. %) | 45.13 | 50.57 | — | — | — | — | — | — |
| Aromatics (wt. %) | 23.80 | 10.72 | — | — | — | — | — | — |
| Cetane index | — | — | 41 | 50 | — | — | — | — |
| $H_2$ consumption $Nm^3/TM$* | — | 113.4 | — | 74.72 | — | 82.35 | — | 233 |

*(TM = metric ton?)

As can be seen from Table VII, the conversion of the 950° F.+ residual fraction is found to be of the order of 80 (wt. %) and the conversion of asphaltenes of the order of 47.8 (wt. %).

EXAMPLE IV

Figure 2:
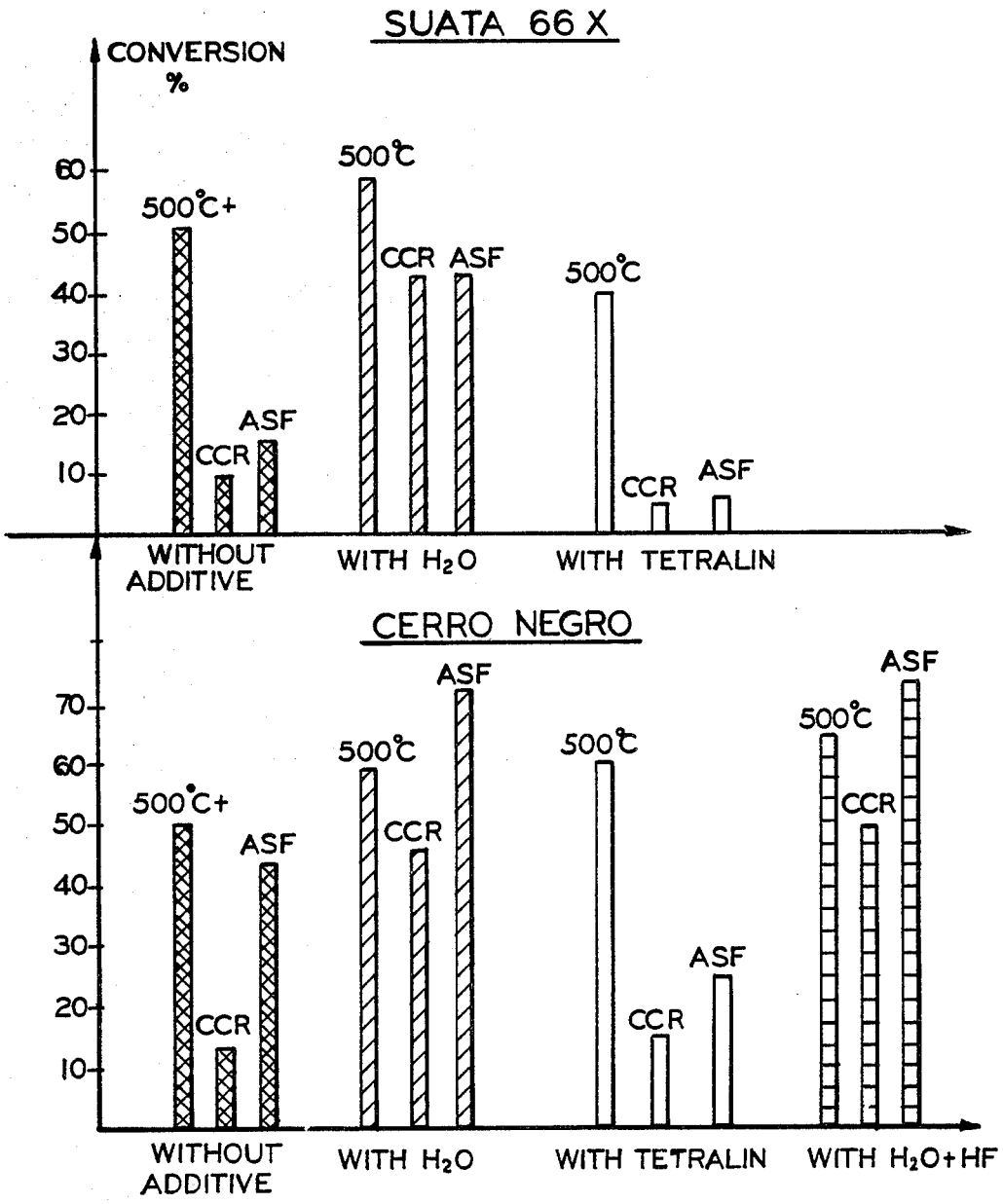
FIG. 2 is a graph illustrating the effect of hydroconversion on the properties of asphaltenes, Conradson carbon and 500° C. plus fraction for Suata 66X crude and Cerro Negro crude.
Figure 3:
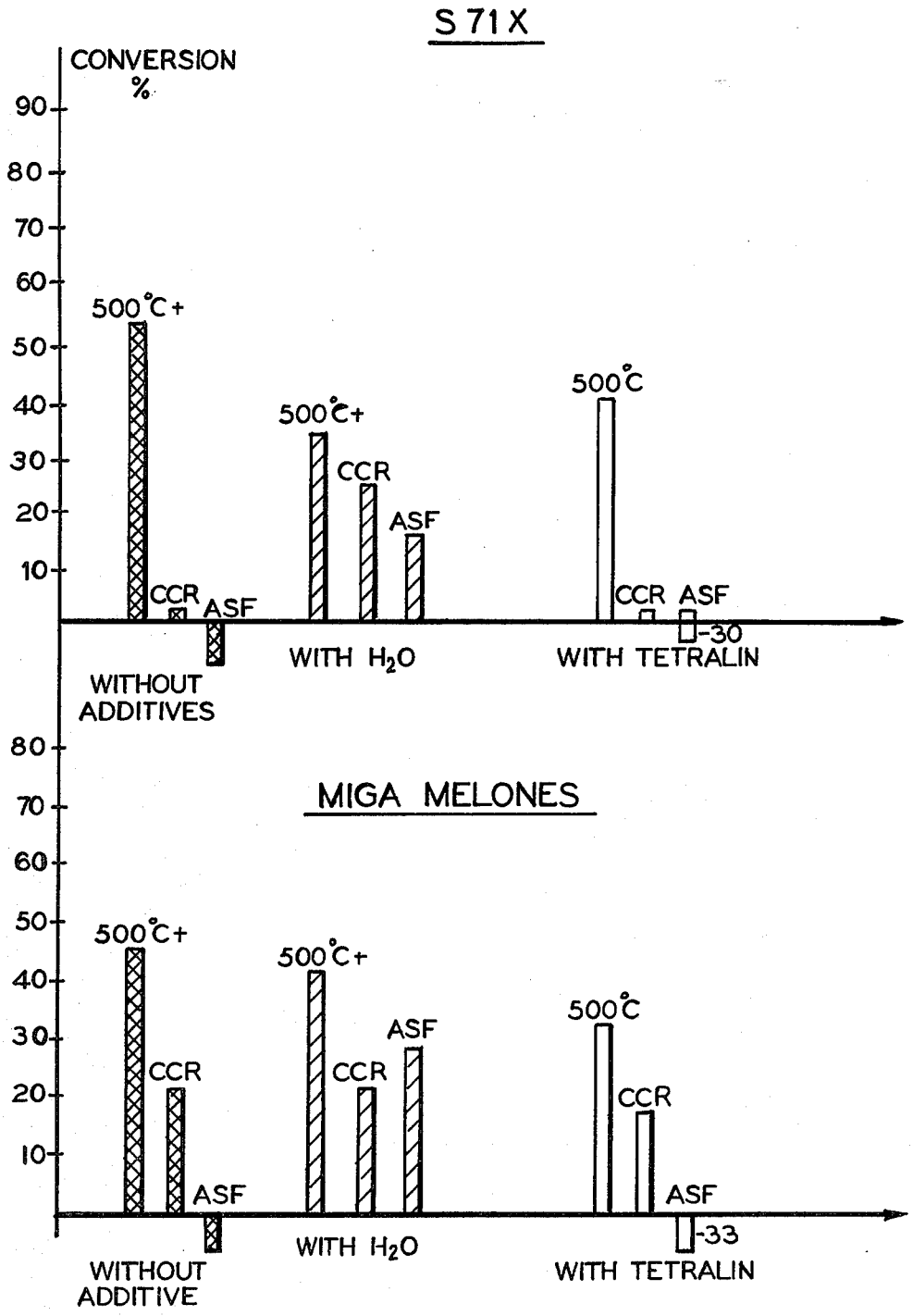
FIG. 3 is a graph illustrating the effect of hydroconversion on the properties of asphaltenes, Conradson carbon and 500° C. plus fraction for Suata 71X crude and Miga-Melones crude.

In this example, a study is presented which was carried out with different charges and different additives kept at 430° C. in the soaker, 127 atmospheres and 1.55 h residence time. In FIG. 2 can be seen the effect of hydroconversion on the properties such as asphaltenes, Conradson carbon, and 500° C.+ fraction for Suata 66X and Cerro Negro crudes, without additive, with water, and with tetralin; it can be seen that water increases the conversion of asphaltenes and Conradson carbon more than tetralin or no additive. Similar results are obtained for Suata 71X and for Miga-Melones (FIG. 3).

EXAMPLE V

In this example there are presented the characteristics of the final product, when the deasphalted residuum is recycled to the thermal hydroconversion stage instead of sending it to hydrotreatment. As can be seen in Table VIII, the recycling of the deasphalted material has the following advantages:

(a) The DAO hydrotreatment stage is eliminated, reducing to some extent the consumption of hydrogen.

(b) The yields of light distillates (950° F.) are increased.

(c) The yield in total volume of synthetic crude is increased.

(d) The final synthetic crude would be constituted solely by light distillates.

TABLE VIII

| YIELDS OF FINAL SYNTHETIC CRUDE WITH RECYCLING OF DAO | | |
|---|---|---|
| CUT | % BY WEIGHT | % BY VOLUME |
| $C_2$- 375° F. | 15.24 | 16.44 |
| 375–650° F. | 45.11 | 45.83 |
| 650–950° F. | 39.65 | 37.73 |
| Total | 100.00 | 100.00 |

°API = 31.8
% Liquid Yield: 104.14 (vol. %)
Hydrodgen consumption: 236.24 $Nm^3$/mt of 350° C.+ *residuum*

The examples as set forth above are meant to be illustrative and in no way limiting to the claims.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A process for upgrading heavy crude feedstock containing more than 5% asphaltenes by the controlled conversion of asphaltenes and resins comprising:

(a) feeding a hydrocarbon feedstock to a first hydroconversion thermal stage wherein said hydrocarbon feedstock is treated with steam and ammonia and hydrogen so as to diminish the content of asphaltenes and resins, wherein the concentration of ammonia is about between 0.1 and 10% by volume and the ratio of the mixture of steam and ammonia is about between 0.1 and 30% by volume with respect to the hydrocarbon feedstock and wherein the ratio of hydrogen to the hydrocarbon feedstock is between about 300 and 4500 $Nm^3/m^3$;

(b) feeding the effluent from said first hydroconversion thermal stage to a second hydroconversion thermal stage wherein said effluent is further treated in the presence of steam and ammonia so as to further diminish the content of asphaltenes and resins; and (c) withdrawing the treated effluent from said second hydroconversion thermal stage and passing said treated effluent to a high pressure-high temperature separator wherein said treated effluent is separated so as to produce a liquid fraction and a residual fraction.

2. A process according to claim 1 including the steps of passing said liquid fraction to a low temperature-high pressure separator wherein hydrogen, $H_2S$ and $NH_3$ are recovered as heads, water and ammonia are removed as bottom products and a light hydrocarbon is produced.

3. A process according to claim 2 including the steps of feeding said light hydrocarbon to a low temperature-low pressure separator wherein $C_1$–$C_4$ are recovered as heads and the condensed hydrocarbons leave as bottom products.

4. A process according to claim 1 including the steps of feeding said residual fraction to an atmospheric distillation column wherein an atmospheric pressure residue is produced.

5. A process according to claim 4 including the steps of feeding the atmospheric pressure residue to a vacuum distillation column so as to produce a vacuum residue.

6. A process according to claim 5 including the steps of feeding said vacuum residue to a decanter wherein said vacuum residue is deasphalted in the presence of water and a solvent so as to produce a deasphalted stream.

7. A process according to claim 6 including the steps of passing said deasphalted stream to an evaporator so as to evaporate the solvent from said deasphalted stream.

8. A process according to claim 7 including the steps of passing said deasphalted stream from said evaporator to a water recovery unit and thereafter feeding said deasphalted stream to a hydrotreatment unit wherein sulfur and vanadium are eliminated from said stream.

9. A process according to claim 1 wherein a mixture of steam and ammonia is introduced into said first hydroconversion thermal stage wherein the concentration of ammonia is about between 0.3 and 8% by volume and the ratio of the mixture of steam and ammonia is about between 0.5 and 10% by volume with respect to the hydrocarbon feedstock.

10. A process according to claim 1 further including feeding preheated hydrogen to said first hydroconversion thermal stage.

11. A process according to claim 1 wherein the residence time in said first hydroconversion thermal stage is between about 0.32 and 64.3 minutes.

12. A process according to claim 1 wherein the temperature of the liquid in the first thermal stage is progressively increased up to a maximum of about between 420° and 540° C.

13. A process according to claim 1 wherein the temperature of the liquid in the first thermal stage is progressively increased up to a maximum of about between 440° and 500° C.

14. A process according to claim 1 wherein the operating pressure in said first hydroconversion thermal stage is about between 20 and 200 atmospheres.

15. A process according to claim 1 wherein the operating pressure in said first hydroconversion thermal stage is about between 50 and 150 atmospheres.

16. A process according to claim 1 including the steps of providing a helicoidal reactor for said first hydroconversion thermal stage.

17. A process according to claim 6 wherein the percentage of water with respect to the solvent is about between 5 and 20% by volume.

18. A process according to claim 17 wherein the solvent is a hydrocarbon comprising $C_5$ to $C_7$ or mixtures thereof.

19. A process according to claim 6 wherein the deasphalting is carried out at a temperature of about between 180° and 230° C. and at a pressure of about between 15 and 50 atmospheres.

20. A process according to claim 6 wherein the solvent/vacuum residue ratio is about between 2:1 and 10:1 by volume.

21. A process according to claim 6 wherein the solvent/vacuum residue ratio is about between 4:1 and 9:1 by volume.

22. A process according to claim 1 including the steps of providing a bubble column type reactor for said second thermal hydroconversion stage wherein the bubble column type reactor is provided with distributors so as to form gas bubbles having a diameter of no greater than 10 cm and wherein the coefficient of axial dispersion is about between 40 and 200 $cm^2$ per second.

23. A process according to claim 8 including the steps of providing a fixed bed reactor as the hydrotreatment unit and providing a porous catalyst in said fixed bed reactor wherein more than 40% of the pores have a radius of greater than 100 Å, a surface area of about between 150 and 300 $m^2/g$ and a pore volume of about between 0.8 and 1.2 $cm^3/g$.

24. A process according to claim 8 wherein the hydrotreatment takes place at pressures of about between 20 and 200 atmospheres and a temperature of about between 350° and 440° C.

25. A process according to claim 8 wherein the hydrotreatment takes place at pressures of about between 50 and 150 atmospheres and a temperature of about between 370° and 430° C.

26. A process according to claim 24 wherein the hydrogen/hydrocarbon ratio varies between 100 and 2,000 $Nm^3/m^3$.

* * * * *